US005303442A

United States Patent [19]

Flanders et al.

[11] Patent Number: 5,303,442

[45] Date of Patent: Apr. 19, 1994

[54] MACHINE FOR LASTING SIDE PORTIONS OF SHOE UPPERS

[75] Inventors: James R. Flanders; Richard E. Storer; Frank Hartshorn, all of Leicester, England

[73] Assignee: British United Shoe Machinery Limited, Leicester, England

[21] Appl. No.: 872,590

[22] Filed: Apr. 23, 1992

[30] Foreign Application Priority Data

Apr. 30, 1991 [GB] United Kingdom ..... 9109270

[51] Int. Cl.[5] ..... A43D 21/00

[52] U.S. Cl. ..... 12/8.3

[58] Field of Search ..... 12/8.3, 7

[56] References Cited

U.S. PATENT DOCUMENTS

| | | | |
|---|---|---|---|
| 2,438,917 | 4/1948 | Kamborian | 12/8.3 |
| 2,701,003 | 2/1955 | Kamborian | 12/8.3 |
| 2,709,268 | 5/1955 | Kamborian | 12/8.3 |
| 2,757,394 | 8/1956 | Kamborian | 12/8.3 |
| 2,843,863 | 7/1958 | Weisz | 12/8.3 |
| 3,803,654 | 4/1974 | Henkel et al. | 12/8.3 |
| 3,971,089 | 7/1976 | Gadd et al. | 12/8.3 |
| 4,078,274 | 3/1978 | Fichtner | 12/8.3 |
| 4,319,373 | 3/1982 | Lauckhardt et al. | 12/8.3 |
| 4,729,140 | 3/1988 | Emmerich | 12/8.3 |
| 4,853,997 | 8/1989 | Giebel | 12/8.3 |
| 4,920,594 | 5/1990 | Flanders et al. | 12/12 X |
| 4,951,338 | 8/1990 | Brown et al. | 69/6.5 X |
| 5,101,528 | 4/1992 | Flanders et al. | 12/77 |

FOREIGN PATENT DOCUMENTS

| | | |
|---|---|---|
| 0271303 | 6/1988 | European Pat. Off. . |
| 3438297 | 6/1985 | Fed. Rep. of Germany . |
| 8610141 | 5/1986 | Fed. Rep. of Germany . |

*Primary Examiner*—Paul T. Sewell
*Assistant Examiner*—Ted Kavanaugh
*Attorney, Agent, or Firm*—Owen J. Meegan; Aubrey C. Brine

[57] ABSTRACT

A side (or heel seat and side) lasting machine comprises two lasting rollers (232; 232') arranged one at either side of a shoe support (20) by which a shoe is supported bottom up. Each roller (232; 232') has a helical rib arrangement (294) which, when rotated while in pressing engagement with the shoe bottom, effects an inwiping movement on the lasting marginal portions of the shoe upper. The rollers (232; 232') are inclined to the longitudinal center line of the shoe support, with their free ends directed heelwardly; the acute angle subtended between each center line and the roller axis of rotation is in the order of 50° to 62°, preferably 57°. The lasting rollers (232; 232') are of non-metallic material, preferably synthetic polymer or ceramic material, and have a single helical rib the pitch of which is in the range of 10 to 15 mm.

15 Claims, 11 Drawing Sheets

MACHINE FOR LASTING SIDE PORTIONS OF SHOE UPPERS

BACKGROUND OF THE INVENTION

This invention is concerned with a machine for lasting side portions of shoe uppers comprising a shoe support for supporting, bottom up, a shoe on a last with an insole on the last bottom, and two side lasting assemblies, arranged one at each side of the shoe support, for operating progressively along opposite side portions of a shoe supported by the shoe support in a direction from the heel end to the toe end, wherein each side lasting assembly comprises a lasting roller having a helical rib arrangement which, as the roller is caused to rotate in engagement with a lasting marginal portion of the upper of such shoe, effects an inwiping action on said portion and presses it against a corresponding marginal portion of the insole of such shoe.

One such machine is described e.g. in GB-A 1 493 937.

In lasting side portions of shoe uppers using a lasting roller of the aforementioned type desirably the surface of the lasting roller should lie firmly against the flat surface of the shoe bottom or, where the surface of the shoe bottom is curved, the surface of the roller should lie tangentially thereto. In order to achieve such an arrangement six separate movements can be identified, namely:

movement lengthwise of the shoe (X-axis movement);
movement widthwise of the shoe (Y-axis movement);
movement heightwise of the shoe (Z-axis movement);
movement about an axis extending parallel to the Z-axis
movement (swing movement);
movement about an axis extending parallel to the Y-axis
movement (tilt movement); and
rotation of the roller.

In the machine described in GB-A 1 493 937 clearly X-axis movement, Z-axis movement and also tilt movement can be effected, but the rollers are arranged with their axes of rotation parallel with each other and with the direction of the Y-axis. Moreover, in said machine, because of the width of the rollers in relation to the width of the lasting marginal portions of shoe uppers to be operated upon, no requirement for Y-axis movement was perceived.

While said machine carried out satisfactory lasting operations in a wide range of cases, nevertheless in certain cases, notably where the shoe upper patterns were poorly cut in relation to the shape of the last, problems occurred in particular at the "outside" of the shoe in the ball region thereof, where the region to be lasted meets the previously toe-lasted portion of the shoe upper, in that a so-called "loop" was frequently found to arise.

One of the problems in determining optimum conditions for operating upon shoe bottoms arises in that different requirements can be identified for the "inside" and "outside" of a shoe bottom. For example it has been established that in order to avoid the formation of a loop at the ball region on the outside of the shoe, as discussed above, preferably the axis of the lasting roller should be inclined to a longitudinal centre line of the shoe support, with the free end of the roller directed towards the heel end of the shoe. For operating on the inside of the shoe, on the other hand, ideally inclining the axis of the roller towards the longitudinal centre line of the shoe support, with the free end of the roller directed towards the toe end of the shoe would appear to give beneficial results, in terms of tightly lasting the upper material to the shape of the last in especially the inside waist region. Moreover, it has further been found that it is beneficial when operating on the outside of the shoe for the direction of rotation of the roller to be such that the surface in engagement with the shoe is moving toewardly, while in the case of the inside of the shoe, as described above, preferably the surface of the roller in engagement with the shoe should be moving heelwardly.

One solution would of course be to provide two rolls at each side of the shoe bottom and utilise one or other, according to whether the shoe being operated upon is a left or a right. Not only is such a solution expensive, however, but also there is a question of space for accommodating two rollers at each side, especially in a situation where such rollers are angled significantly from one another.

OBJECT OF THE INVENTION

In determining, therefore, whether any of the six parameters referred to above should be variable or remain constant through a lasting cycle of operation, the avoidance of loops on the outside of the shoe on the one hand and on the other ensuring that the inside waist in particular is tightly lasted have to be borne in mind.

SUMMARY OF THE INVENTION

The present invention provides, in one of its several aspects, a machine for lasting side portions of shoe uppers comprising a shoe support for supporting, bottom up, a shoe on a last with an insole on the last bottom, and two side lasting assemblies, arranged one at each side of the shoe support, for operating progressively along opposite side portions of a shoe supported by the shoe support in a direction from the heel end to the toe end, wherein each side lasting assembly comprises a lasting roller having a helical rib arrangement which, as the roller is caused to rotate in engagement with a lasting marginal portion of the upper of such shoe, effects an inwiping action on said portion and presses it against a corresponding marginal portion of the insole of such shoe, and further wherein the axis of rotation of each roller is inclined to a longitudinal centre line of the shoe support, with the free end of the roller directed towards the heel end of the shoe, the acute angle subtended between said centre line and said axis being in the range of 50° to 62°.

It will thus be appreciated that the swing movement is fixed at an angle within said range of 50° to 62°, and moreover with such an angle of inclination it has been found that the formation of loops along the outside edge can be avoided while nevertheless satisfactory lasting takes place at the inside waist region. In a preferred embodiment, furthermore, the subtended acute angle is in the order of 57°.

For enhancing the lasting effect achieved by the machine in accordance with the invention, furthermore, preferably the direction of rotation of each roller is such that the surface portion thereof in pressing engagement with the shoe is moving toewardly.

Another area in which some conflict arises between optimum conditions for the lasting of inside and outside portions of the shoe bottom is identified as the diameter of the roller. For lasting the outside of the shoe it has been found that a diameter of up to 35 mm gives good results whereas in the inside waist region in particular the smaller the diameter the better the quality of lasting. Moreover, it has also been found that the lasting effect is particularly enhanced in the inside waist region of the shoe where the helical rib arrangement comprises a single rib and the pitch thereof is such that only one or at most two rib portions are in contact with the lasting marginal portions of the shoe upper at any given time.

In accordance with the invention, therefore, preferably the outside diameter of each roller is in the order of 15 to 25 mm; more particularly rollers having an outside diameter of 18 mm and 22 mm have been found to be particularly successful. In addition with the helical rib arrangement comprising a single rib the pitch of which is in the order of 10 to 15 mm, preferably 12 to 13 mm, again good lasting results have been achieved especially in the inside waist region. The good lasting quality is especially found, moreover, where the height of the rib is in the order of 1.5 to 2.5 mm; in a preferred embodiment a rib height of 2 mm has been found particularly successful.

One reason why it is believed that the use of a roller dimensioned as aforesaid gives good lasting results may reside in the fact that, using such a roller, the applied pressure can be reduced as compared with a conventional metal lasting roller. It is believed, furthermore, that the relatively high pressure which has to be applied using a lasting roller of metal contributes to the formation of loops at the outside region.

In a machine in accordance with the invention preferably each lasting roller is supported for tilting movement about an axis extending perpendicularly to the axis of rotation of the roller thus to vary the angle at which the roller is pressed into engagement with the shoe as aforesaid. In order, furthermore, that the tilting movement can be effected during the lasting cycle with the particular purpose of following the lateral contour of the shoe bottom (tilt movement), preferably an n.c. motor is provided for effecting such tilting movement of the lasting roller. By the use of an n.c. motor, it will be appreciated, the machine is thus suited to programme control and to the "teaching" of a particular shoe style for ensuring that the tilt movement accommodates the lasting roller closely to the lateral contour of the shoe bottom. (By the phrase "n.c. motor" where used herein is to be understood a motor the operation of which is controlled by control signals supplied thereto in accordance with digitised information appropriate to the desired operation of the motor. Examples of such motors are stepping motors and d.c. servo motors.)

For ensuring that such tilting movement takes place in timed relationship with relative movement, in a direction lengthwise of the shoe, between the lasting rollers and the shoe support (X-axis movement) conveniently each lasting roller is mounted in a carriage movable in a rectilinear path, an n.c. motor being provided for effecting such movement. In this way the operation of the n.c. motor controlling the tilt movement can be coordinated with the operation of the n.c. motor effecting X-axis movement.

For ensuring that each lasting roller is maintained in contact with the shoe bottom as it operates progressively therealong, each roller is conveniently mounted for heightwise movement relative to the shoe support (Z-axis movement), and.-preferably each lasting roller is supported on a mounting for pivotal movement about an axis extending lengthwise of a shoe supported by the shoe support, fluid pressure operated means being provided for urging the support in a direction to press the lasting roller into engagement with a shoe supported by the shoe support or in an opposite direction to move the roller to an out-of-the-way position. Moreover, in a preferred embodiment means is provided for varying the pressure of fluid applied to said fluid pressure operated means thus to vary the pressure under which the lasting roller is pressed into engagement with the shoe.

Although it is envisaged that the lasting rollers of the machine in accordance with the invention will be sufficiently long to cover the majority of shoes to be operated upon, it is envisaged that from time to time marginal portions of a shoe may extend across the longitudinal centre line of the shoe support, with a result that the lasting roller will tend to run off the shoe bottom; it will of course be appreciated that the lasting rollers are preferably arranged such that they are adjacent each other and disposed symmetrically of the longitudinal centre line of the shoe support when in a centralised position. To this end, therefore, conveniently each lasting roller is mounted on a support for bodily movement in a direction extending transversely of the longitudinal centre line of the shoe support, the arrangement being such that as one of said rollers is moved in a direction towards the other said other is withdrawn and vice versa. Where the lasting roller is supported on a mounting as described above, furthermore, the mounting is preferably mounted on such a support. More particularly, preferably each support is supported for pivotal movement from a central position in either direction under the control of fluid pressure operated means. In a preferred embodiment of the machine, therefore, the axis about which tilt movement of each lasting roller takes place is carried by the mounting by which the Z-axis movement takes place, which mounting in turn is carried by the support by which the Y-axis movement is achieved.

Other aspects of the invention, including the lasting roller aspect thereof, will be found set out in the appended Claims.

BRIEF DESCRIPTION OF THE DRAWINGS

There now follows a detailed description, to be read with reference to the accompanying drawings, of a lasting roller and also a machine for lasting side and seat portions of shoe uppers, said lasting roller and machine having been selected for description merely by way of exemplification of the various aspects of the present invention.

In the accompanying drawings.

The machine now to be described is a so-called seat and side lasting machine in the operation of which heel seat and side portions of a shoe upper, which carried on a last having an insole on the last bottom and which has already been lasted in the toe region thereof, are lasted, more particularly the lasting of the side portions is first initiated, from the region of the heel breast line toewardly, and thereafter the lasting of the seat portion is effected.

Figure 5:
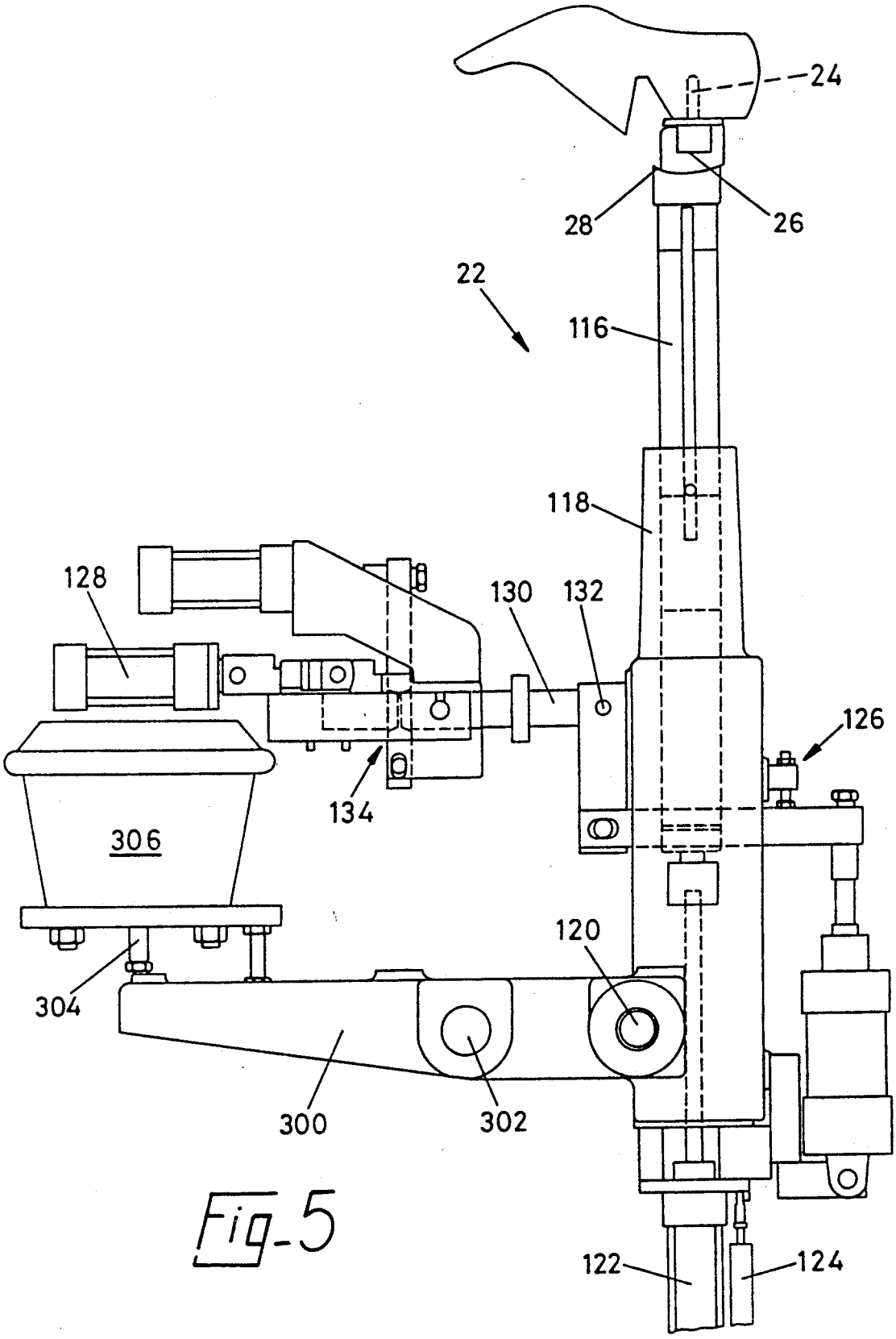
FIG. 5 shows details of a jack post forming part of the shoe support.

This machine thus comprises a shoe support generally designated 20 (FIG. 2) for supporting, bottom up, a shoe, the toe end portion of which has already been lasted, for side and seat lasting operations to be performed thereon. To this end, the shoe support 20 comprises a jackpost 22 (FIGS. 2 and 5) including a last pin 24 which is capable of limited sliding movement, transversely of the longitudinal centre line of the shoe, in a slide 26 which itself is mounted for arcuate sliding movement, generally in the lengthwise direction of the shoe bottom, on a further slide 28 supported by the jackpost 22. In this way it is possible for the heel seat region of the shoe bottom to be correctly levelled in relation to a wiping plane, to be referred to hereinafter, of the machine.

Figure 4:
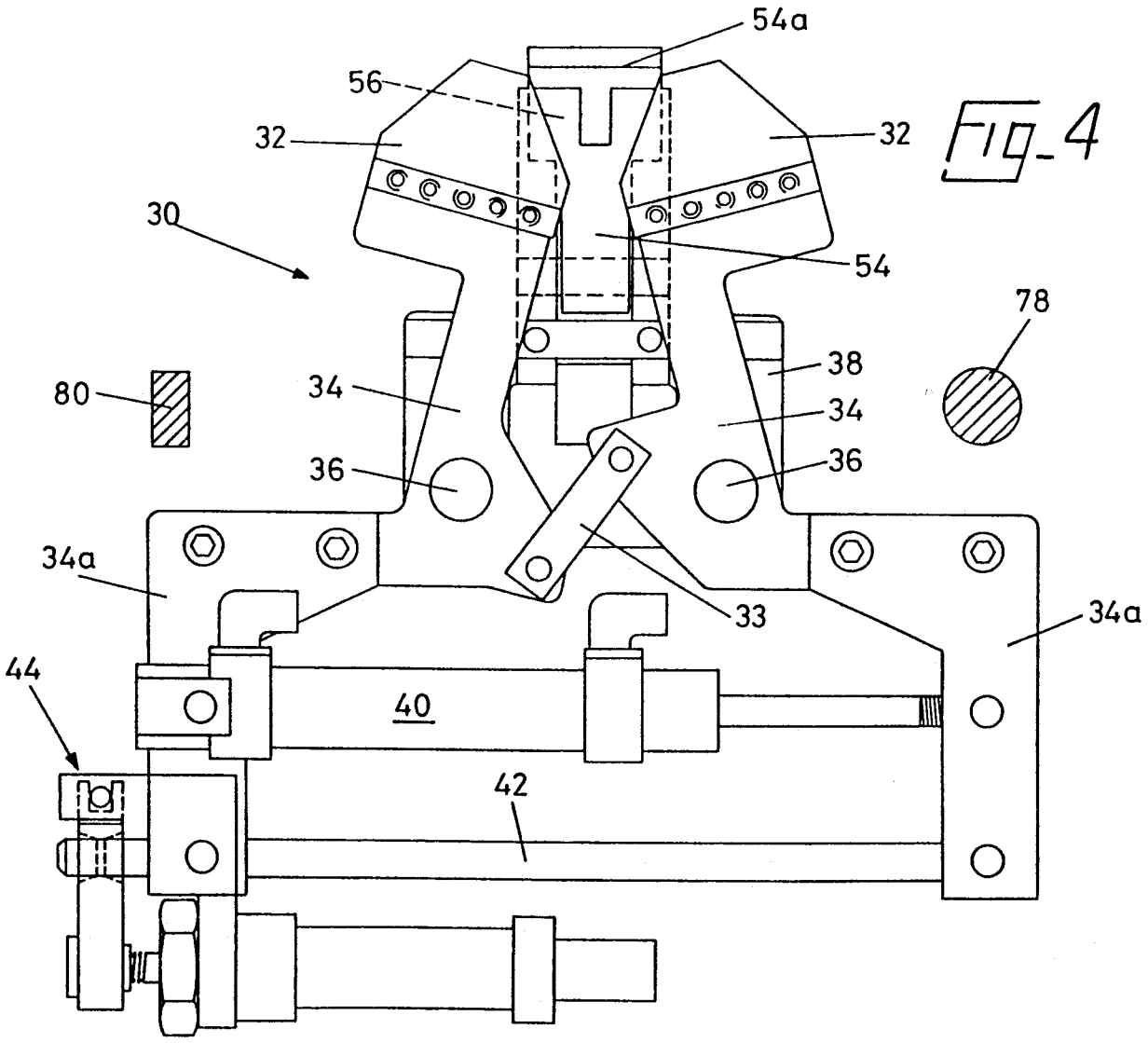
FIG. 4 is a view along the arrow IV in FIG. 2, showing details of a toe support of said shoe support.

The shoe support 20 also comprises a toe support generally designated 30 (FIGS. 2 and 4) which comprises two blocks 32 having inwardly facing inclined surfaces which together form a generally V-shaped support surface for the toe end of the shoe. The blocks 32 are supported on a linkage comprising two levers 34, for pivotal movement towards or away from each other, a link 33 extending between the levers 34 thus to cause them to move equidistantly. The levers 34 are mounted for pivotal movement, each on its own pivot 36, on a support block 38. Extending between lower, bifurcated, ends 34a of the levers 34 is a piston-and-cylinder arrangement 40 by which the lower ends of the levers are drawn together or moved apart, thus effecting movement of the blocks 32 away from or towards one another. A shaft 42 is also mounted between the lower ends of the levers 34, being fixedly mounted to one of said ends and slidably accommodated in a block fixed to the bifurcated lower end 34*a* of the other. This shaft 42 forms part of a pneumatically operated bar-lock arrangement generally designated 44, by which the blocks 32 may be locked in adjusted position.

For determining the heightwise position of the toe end of a shoe in relation to the blocks 38 an abutment plate 54 is provided, pivotally mounted on an upstanding bracket 56 on the support block 38. The plate is spring-urged into an operative position in which an inclined face of a lip 54*a* can be engaged by the tip of the toe portion of a shoe placed on the jack post, said lip thus providing a toe height datum for such shoe. As will be described hereinafter, there is associated with the plate 54 an inductance switch 58 which when the plate is pivoted by engagement with the shoe, provides a signal in response to which the blocks 32 are caused to move towards one another and thus to urge the shoe upwardly against said lip 54*a*.

The support block 38 is mounted for heightwise adjusting movement in the shoe support 20, and to this end is supported on a slide rod 46 which is mounted for vertical sliding movement in a further support block 48. The slide rod 46 threadedly receives at its lower end a ball screw 50 which in turn is connected to the output of a stepping motor 52 carried on the underside of the further support block 48. Thus, actuation of the stepping motor 52 is effective to cause heightwise movement of the support block, and thus of the blocks 32 and plate 54, to take place. In this way the heightwise position of the toe support can be determined according to the style of shoe being operated upon.

The further support block 48 is mounted for sliding movement, transversely of the shoe bottom, on a shaft 60, a rectangular bar (not shown) being provided parallel to the shaft 60 and spaced therefrom, in order to "steady" the further support block 48 as it slides along the shaft 60. The shaft 60 and bar are mounted in a carriage 64 of the toe support 30, as will be referred to hereinafter. For effecting sliding movement of the further support block 48 along the shaft 60, and thus effecting sliding movement of the blocks 32 widthwise of the shoe to be supported thereby—this facility being provided for enabling the toe ends of left and right shoes to be supported in the machine with the longitudinal centre line of their heel seat correctly positioned in relation to a longitudinal centre line of the shoe support (and thus of an operating locality of the machine of which the shoe support may form part)—a further piston-and-cylinder arrangement 66 is provided. For limiting such transverse movement of the further support block 48, furthermore, two abutments in the form of lugs 68 (one only shown in FIG. 2) are mounted for sliding movement in a channel 70, by which the lugs are restrained from any rotational movement. The lugs are themselves mounted on a threaded rod (not shown), one half of the thread being a left-hand and the other a right-hand so that upon rotation of said rod the lugs 68 are moved towards or away from one another. The rod is itself supported in the carriage 64 and is driven by a stepping motor 74 itself also mounted on the carriage 64. By appropriate signals to the stepping motor 74, therefore, it will be appreciated, the lugs 68 may be positioned in a desired relationship with one another according to the size (more particularly the width) of the toe end of the shoe to be supported by the blocks 32. Cooperating with the lugs 68, furthermore, is a pin 76 which is carried on the further support block 48. It will thus be appreciated that, by engagement of the pin 76 with one or other of the lugs 68, the position of the support block 48, and thus of the blocks 32, widthwise of the shoe, can be established.

The carriage 64 is supported at one side by a slide rod 78 and at the other by a rectangular bar 80 which extends in a direction lengthwise of a shoe supported by the last pin 24. The carriage 64 can thus slide in said lengthwise direction relative to the jackpost 22 for accommodating shoes of different length. To effect such sliding movement a piston-and-cylinder arrangement 82 is provided secured at one end to a frame portion 83 of the shoe support 20 and at its other to the carriage 64. A linear potentiometer 84 is also provided, secured at one end to the frame portion 83 and at its other to the carriage 64, thus to provide a signal corresponding to the position of the toe support in relation to the jackpost 22, whereby the length of a shoe to be operated upon can be "measured".

Figure 2:
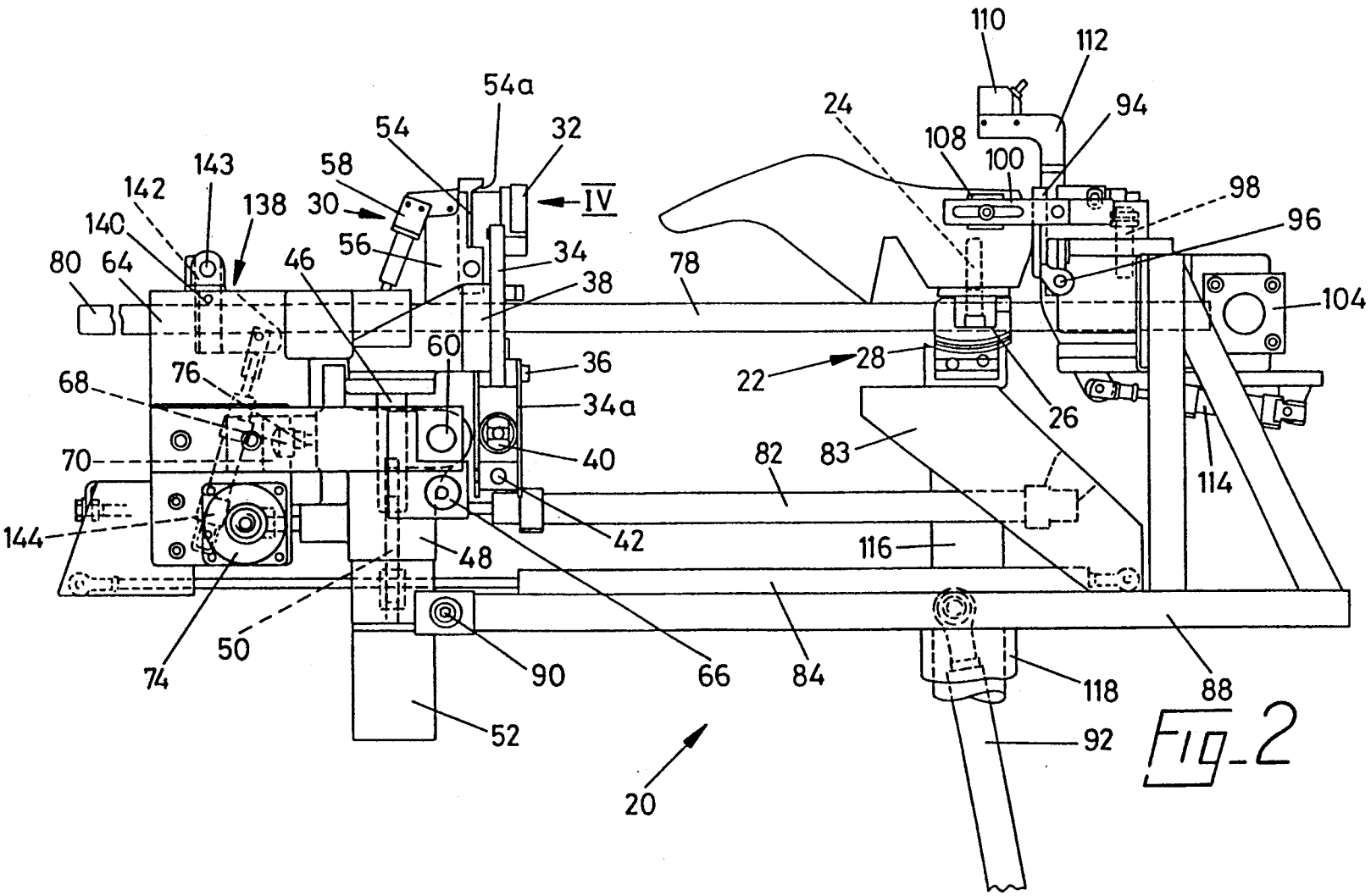
FIG. 2 is a fragmentary side view showing details of a shoe support of the machine.
Figure 3:
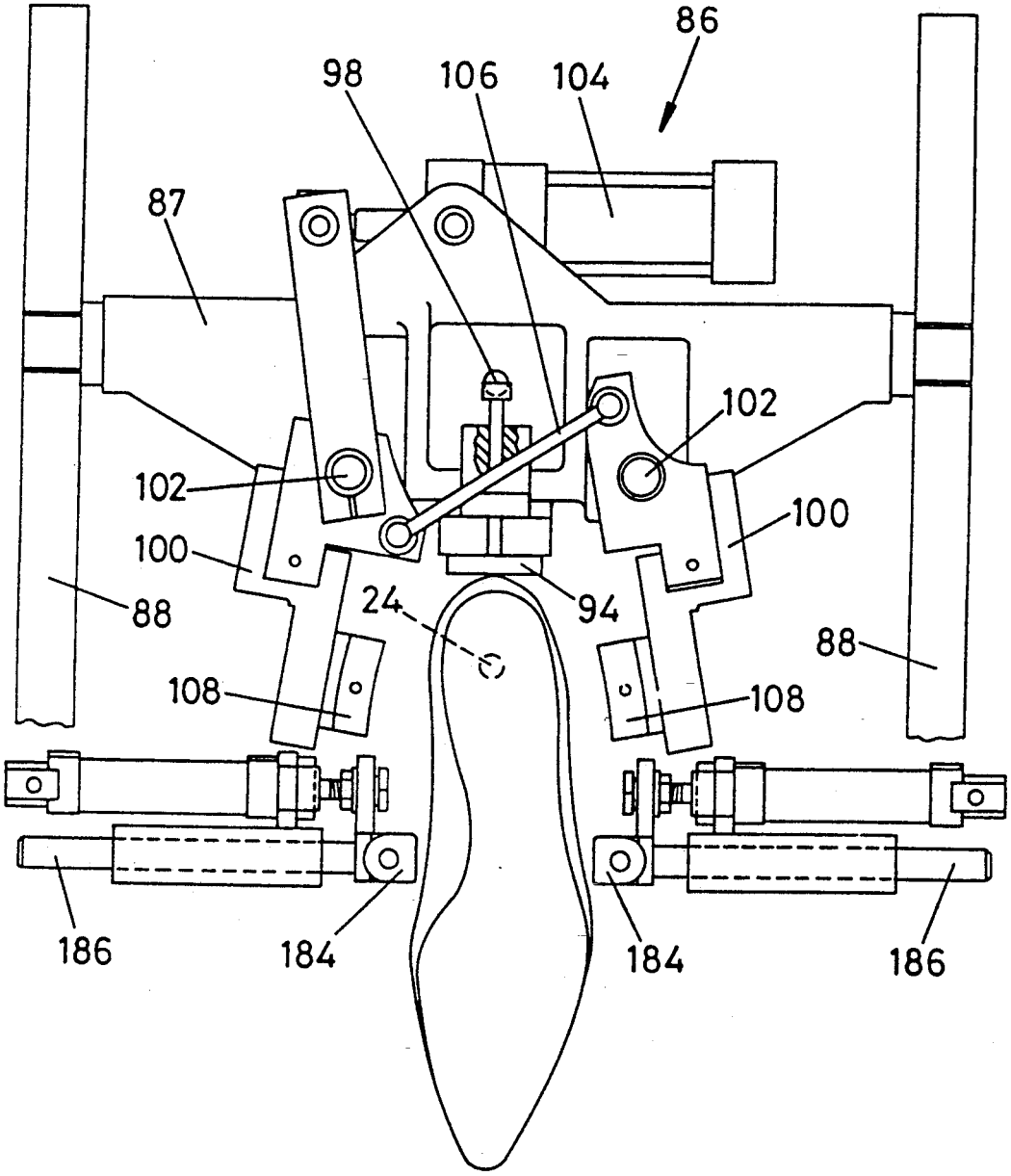
FIG. 3 is a fragmentary plan view showing further details of parts shown in FIG. 2.

The shoe support 20 also comprises a shoe heel end positioning mechanism generally designated 86 (FIGS. 2 and 3) comprising a casting 87 which is carried on a frame portion 88 mounted for pivotal movement about a pivot 90 carried on the frame of the shoe support 20. The shoe heel end positioning mechanism 86 is thus mounted for pivotal movement between an operative position (as shown in FIG. 2) and an out-of-the-way position. For effecting such pivotal movement, furthermore, two piston-and-cylinder arrangements 92 are provided, connected one to each side of the frame portion 88 and mounted on a stationary portion of the frame of the shoe support 20.

Supported by the casting 87 is a plate member 94 which can be engaged by the backseam region of a shoe placed on the jackpost 22 to provide a lengthwise datum for such shoe in the shoe support 20. The plate 94 is spring-urged in a direction towards the jackpost 22 about a pivot 96. When engaged by a shoe, the plate is urged in a direction away from the jackpost (clockwise, viewing FIG. 2 and thus actuates an inductance switch 98 in response to actuation of which a control signal is supplied, as will be referred to hereinafter.

Also mounted on the casting 87 are two socalled seat clamp members 100, each for pivotal movement about a pivot 102 on the casting. A rearward end of one of the members 100, furthermore, is connected to a piston-and-cylinder arrangement 104, and the clamp members 100 are interconnected by a connecting rod 106 whereby they are moved equidistantly towards or away from one another. The effect of moving the clamp members 100 equidistantly towards the heel end of the shoe is to centralize the heel seat of the shoe, that is to say to locate the longitudinal centre line of the heel seat of the shoe coincident with the longitudinal centre line of the shoe support. The clamp members 100 each support a clamp pad 108 which is shaped to conform to the region of the feather edge of the shoe in the vicinity of the heel breast line.

Also mounted on the casting 87 is a heel seat height gauge device 110 (FIG. 2). This device 110 is carried on a lever 112 pivotally mounted on the casting 87, a piston-and-cylinder arrangement 114 being carried on the underside of the casting 87 for effecting such pivotal movement. The device 110 is of the photoelectric switch ("range finder") type by which the distance of an object spaced from it can be detected. Such devices are conventional and readily commercially available.

The jackpost 22 comprises a post 116 (FIGS. 2 and 5) on which the slide 28 is mounted for arcuate movement, as referred to above. The post 116 is slidable, in a direction heightwise of the bottom of a shoe supported by it, in a mounting thereof in the form of a casting 118 which is mounted for limited pivotal movement about an axis 120 (FIG. 5) extending widthwise of such shoe, as will be referred to hereinafter. For effecting heightwise movement of the post 116 a piston-and-cylinder arrangement 122 is mounted on the bottom end of the casting 188 and a piston rod therefor is operatively connected with the post 116. Also associated with the movement of the post 116 is a linear potentiometer 124 by which the heightwise position of the post 116 in relation to the casting 118 can be monitored. A pneumatically operated bar lock arrangement generally designated 126 is operable to lock the post 116 in its adjusted heightwise position.

For effecting limited rocking or pivotal movement of the casting 118 on the pivot 120 a piston-and-cylinder arrangement 128 is mounted on the frame of the shoe support 20 and is connected to a rod 130 which is pivotally connected at 132 to the casting 118. The piston-and-cylinder arrangement 128 is double-acting. A further pneumatic bar lock arrangement generally designated 134 acts on the rod 130 to lock it, and thus also the casting 118 and jackpost 22, in position in a direction extending lengthwise of the shoe bottom.

The carriage 64 of the toe support 20 is also provided with a bar lock arrangement generally designated 138 (FIG. 2). This arrangement comprises a locking plate 140 having an aperture through which the slide rod 78 passes and which is pivotally mounted in a support plate 142, pivotal movement of the locking plate 140 under the influence of a piston-and-cylinder arrangement 144 being effective to lock the plate 140 in relation to the slide rod 78. The support plate 142 is itself mounted in the carriage 64 for limited rocking movement about a pivot 143, the limit being determined by a stop rod (not shown). The effect of this arrangement is that after the bar lock arrangement 138 has been applied and the plate 140 is in locking contact with the slide rod 78, nevertheless the carriage is capable of limited movement, as determined by the stop rod 146, in a direction away from the jackpost 22, for a purpose to be described hereinafter.

When a shoe is to be lasted, the operator first places the shoe, which has already been toe-lasted, on the last pin 24 and then urges the shoe towards the plate member 94, the slide 28, and the last pin therewith thus being caused to slide in the shoe-lengthwise direction; in addition the jackpost 22, which is at this stage under merely a balancing pressure applied through the piston-and-cylinder arrangement 128 to facilitate this, moves also towards the plate 94. Upon contact between the backseam of the shoe and the plate 94, the inductance switch 98 is actuated and a signal is thus generated in response to which firstly the heel seat height gauge device 110 is moved from an out-of-the-way position into its operative position and in addition pressure fluid is supplied to the piston-and-cylinder arrangement 82 to cause the carriage 64, and thus the toe support 30, to move towards the jackpost 22. The arrangement is such that initially fluid under relatively high pressure is applied to the arrangement 82 in order to initiate such movement, whereafter the pressure is reduced, but nevertheless is sufficient to maintain the movement of the carriage. At the stage, furthermore, the blocks 32 are spaced apart.

As the toe support 30 reaches the toe end of the shoe, sides of the toe end are engaged by the blocks 32 and the tip of the toe end of the shoe is engaged beneath the lip **54*a* of the abutment plate 54, whereupon the latter is rocked anti-clockwise (viewing FIG. 2) and a signal is thus generated in response to the consequent actuation of the inductance switch 58. In response to this signal firstly the bar lock arrangement 138 is applied, thus to lock the carriage 64 in position, whereafter fluid pressure is applied to the opposite side of piston-and-cylinder arrangement 82 thus to allow the carriage 64 to retract slightly from the plate member 94, within the constraints of the pivotal movement of the support plate 142. In this way the shoe is maintained in position without its being at this stage forced against the plate 94. In this condition the signal generated in response to actuation of the inductance switch 58 is then effective to cause simultaneously the blocks 32 to move towards one another and also to cause the post 116 of the jackpost to rise in response to the application of pressure fluid to piston-and-cylinder arrangement 122. The upward movement of the jackpost, which can thus take place without the shoe being forced against the plate 94 and thus being dislodged on its last, is monitored by the device 110 which cooperates with the linear potentiometer 124 to bring the insole on the shoe bottom to the height datum of the shoe support. This height datum is determined in relation to the previously mentioned wiping plane of the machine. The inward movement of the blocks 32 serves, by reason of the inclined surfaces thereof, to force the shoe toe against the under-side of the lip 54***a* thereby establishing the toe of the shoe at the desired toe height datum, and at the same time serves to centralise the toe end of the shoe.

In this regard, it should be noted that the machine will have been set up previously according to whether the shoe to be operated upon is a left or a right, and the support block 48 will have been positioned accordingly, as determined by the engagement of the pin 76 with one or other of the lugs 68. Moreover, the position of the lugs will have been determined according to the style of shoe being operated upon, as will also the height of the toe support 30.

At this stage the seat clamp members 100 are moved inwards so that their pads 108 engage and clamp the shoe at the level of the featherline in the region of the heel breast line thereof, and thus centralise it. The device 110 is then retracted. Thereafter the application of fluid pressure to the piston-and-cylinder arrangement 82, to urge the toe support 30 away from the jackpost 22, is discontinued and also the bar lock arrangement 44 is applied, locking the blocks 32 in position.

With the shoe thus positioned its length can then be "measured" by the linear potentiometer 84 in readiness for the subsequent lasting operation.

Figure 6:
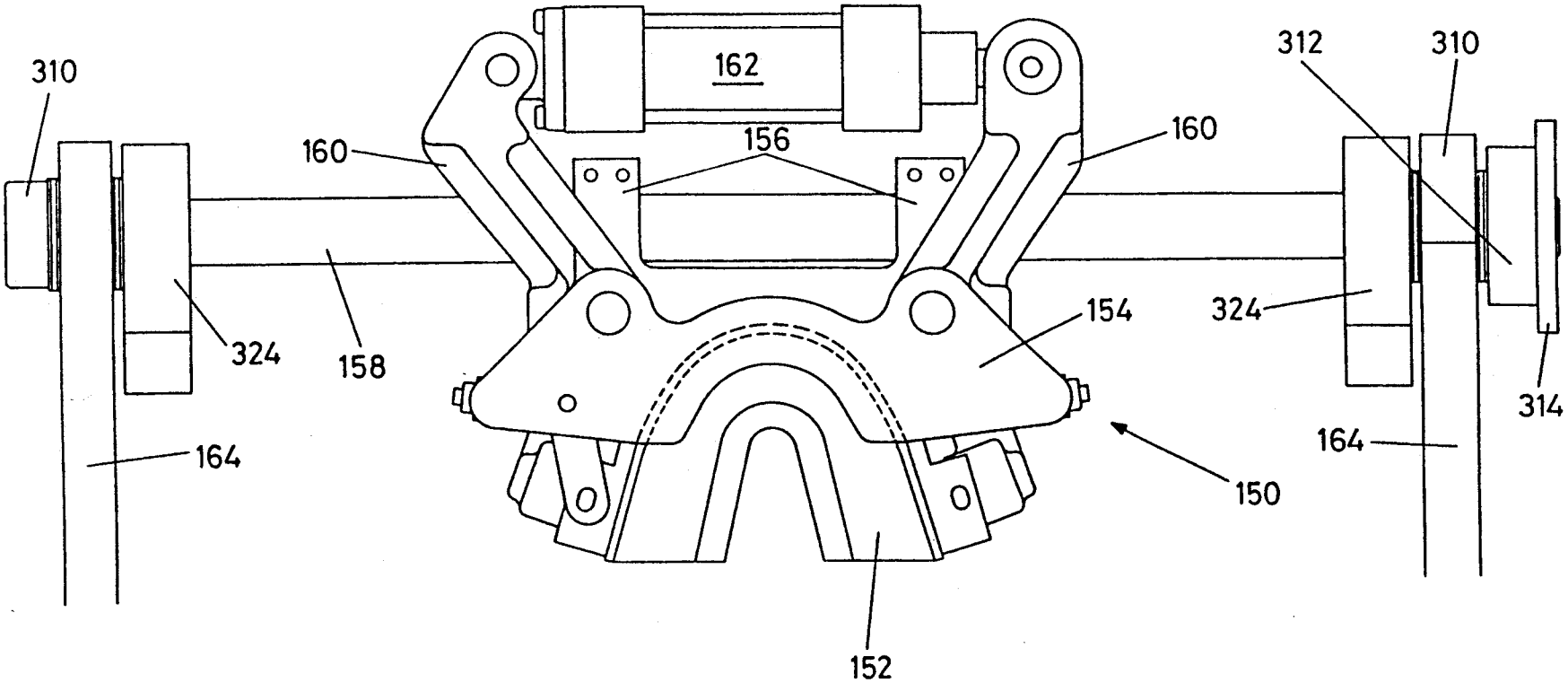
FIG. 6 shows details of a heel band mechanism forming part of the shoe support.

The machine in accordance with the invention also comprises a heel band mechanism generally designated 150 (FIG. 6) by which a conventional heel band 152 can be brought into engagement with the heel end of a shoe supported by the shoe support 20; it will of course be appreciated that in order for this mechanism to engage the heel end of a shoe it will first be necessary to remove the shoe heel end positioning mechanism 86 from engagement with such heel end, for which purpose of course said mechanism is mounted on the frame portion 88 for pivotal movement about the pivot 90 into and out of an operative position as aforesaid.

The heel band mechanism 150 comprises a casting 154 provided with two rearwardly extending lugs 156 by which the casting is mounted on a support rod 158 extending in a direction transversely of the shoe bottom. Mounted on the casting, one at each side thereof, are two bell crank levers 160 forward (i.e. towards the jackpost 22) ends of which support wing portions of the heel band 152. Supported between the rearward ends of the levers 160 is a piston-and-cylinder arrangement 162 actuation of which is thus effective to move the forward ends of the levers 160 towards or away from one another, thus to enable the heel end of a shoe to be clamped and subsequently released by the heel band 152.

The support rod 158 is itself supported at its opposite ends by a frame 164 which is mounted for pivotal movement, about an axis 166 extending widthwise of the bottom of a shoe supported by the shoe support, whereby the heel band mechanism 150 can be moved between an operative position, in which it can engage the heel end of a shoe supported by the last pin 24, and an out-of-the-way position. A piston-and-cylinder arrangement 168 is mounted on a stationary portion of the machine frame and is connected to the frame 164 to effect such pivotal movement.

Figure 7:
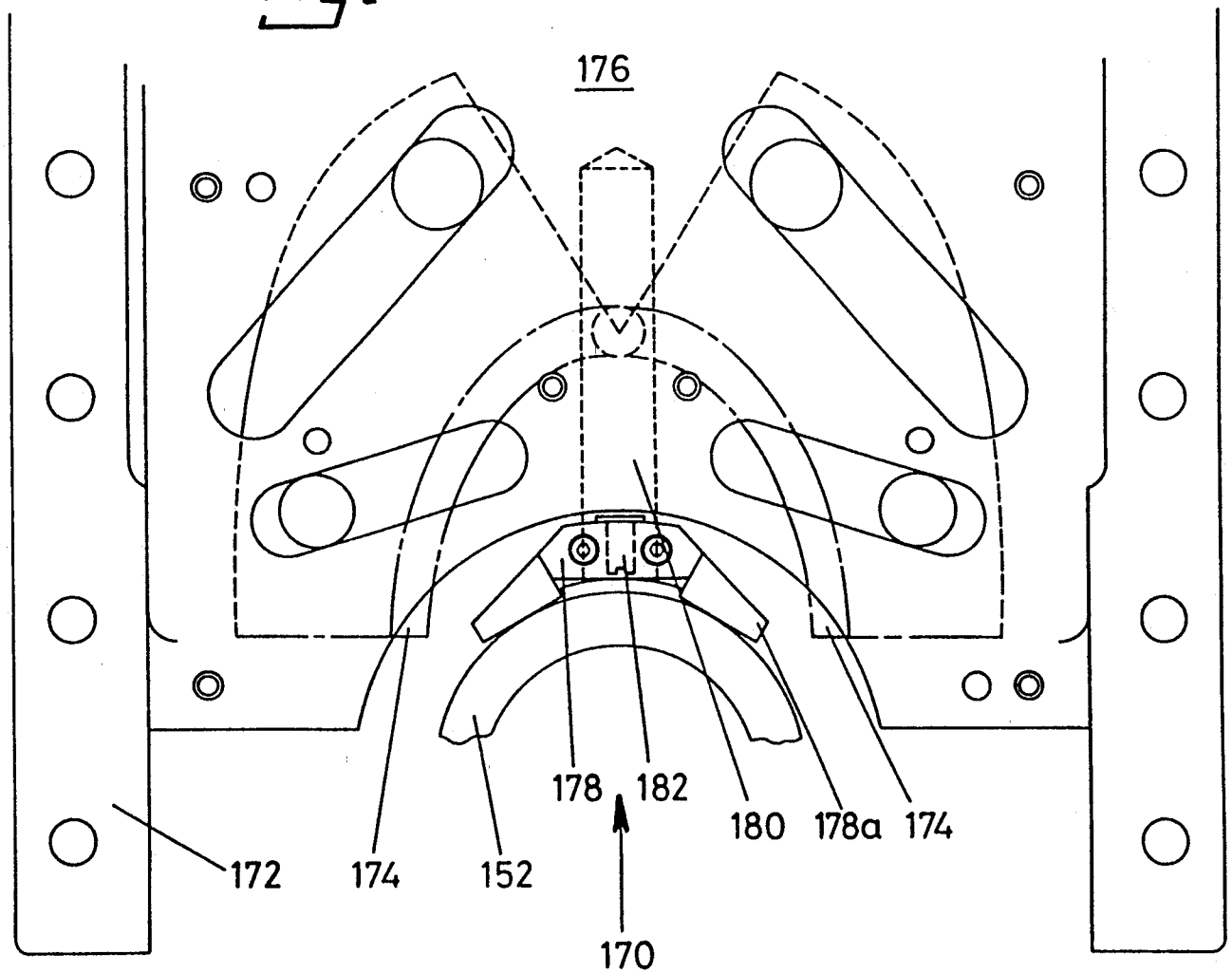
FIG. 7 shows details of a wiper head of the machine in accordance with the invention.

The machine also comprises a wiper mechanism generally designated 170 (FIG. 7) which is of generally conventional construction and comprises a wiper head 172 which is slidable towards and away from the jackpost 22 under the action of a piston-and-cylinder arrangement (not shown). The wiper head supports a pair of wiper plates 174 which, under the action of a cam plate 176, effect a forward and inward wiping movement over the heel end of a shoe. The wiper head 172 is bodily movable into an operative position, this position being determined by a block 178 engaging a back surface of the heel band 152 and urging the heel band into engagement with the backseam region of the shoe; in this way the wiper head is always positioned in a desired relationship with the heel end of the shoe prior to initiation of the forward and inward wiping movement of the wiper plates. More particularly, the block 178 is mounted on a spigot 180 which is accommodated within the wiper head and spring-urged in a direction away from the jackpost, an adjustable stop pin 182 being provided in the block and engaging with a surface of the wiper head thus to determine the position of the block in relation to the wiper head. The block 178 is provided with two wings 178*a*, at opposite ends thereof, by which it engages and presses on the back surface of the heel band 152 at opposite sides of the backseam region thereof. It will thus be appreciated that by varying the position of the stop pin 182, the relationship between the initial position of the wipers prior to the start of the forward and inward wiping movement thereof, and thus the amount by which the wiper plates over-wipe the shoe upper, can be pre-set.

It will be appreciated that, because the heel band is, in its final stage of movement, urged into engagement with the heel end of the shoe by the advancing wiper head 172, it moves in a direction which is parallel, or substantially so, to the plane in which the heel seat of the shoe is located, thereby minimising the risk of dislodging the upper on its last, which could of course occur if the band followed an arcuate path into clamping engagement therewith.

After the heel end of the shoe has been engaged by the heel band in the aforementioned manner, actuation of the piston-and-cylinder arrangement 162 is effective to close the wings of the heel band 152 under clamping pressure against the sides of the shoe.

The shoe support 20 is provided, in addition to the seat clamp members 100, with two further or auxiliary side clamp members 184, mounted, one at each side, on a frame portion of the shoe support and movable into engagement with a shoe supported by the shoe support under the action of piston-and-cylinder arrangements 186. The side clamp members 184, as will be explained later, cooperate with the toe support 30 to maintain the shoe firmly in the shoe support when the seat clamp members 100, which of course form part of the shoe heel end positioning mechanism 86, are retracted prior to the heel band 152 being brought into engagement with the heel end of the shoe.

Figure 1:
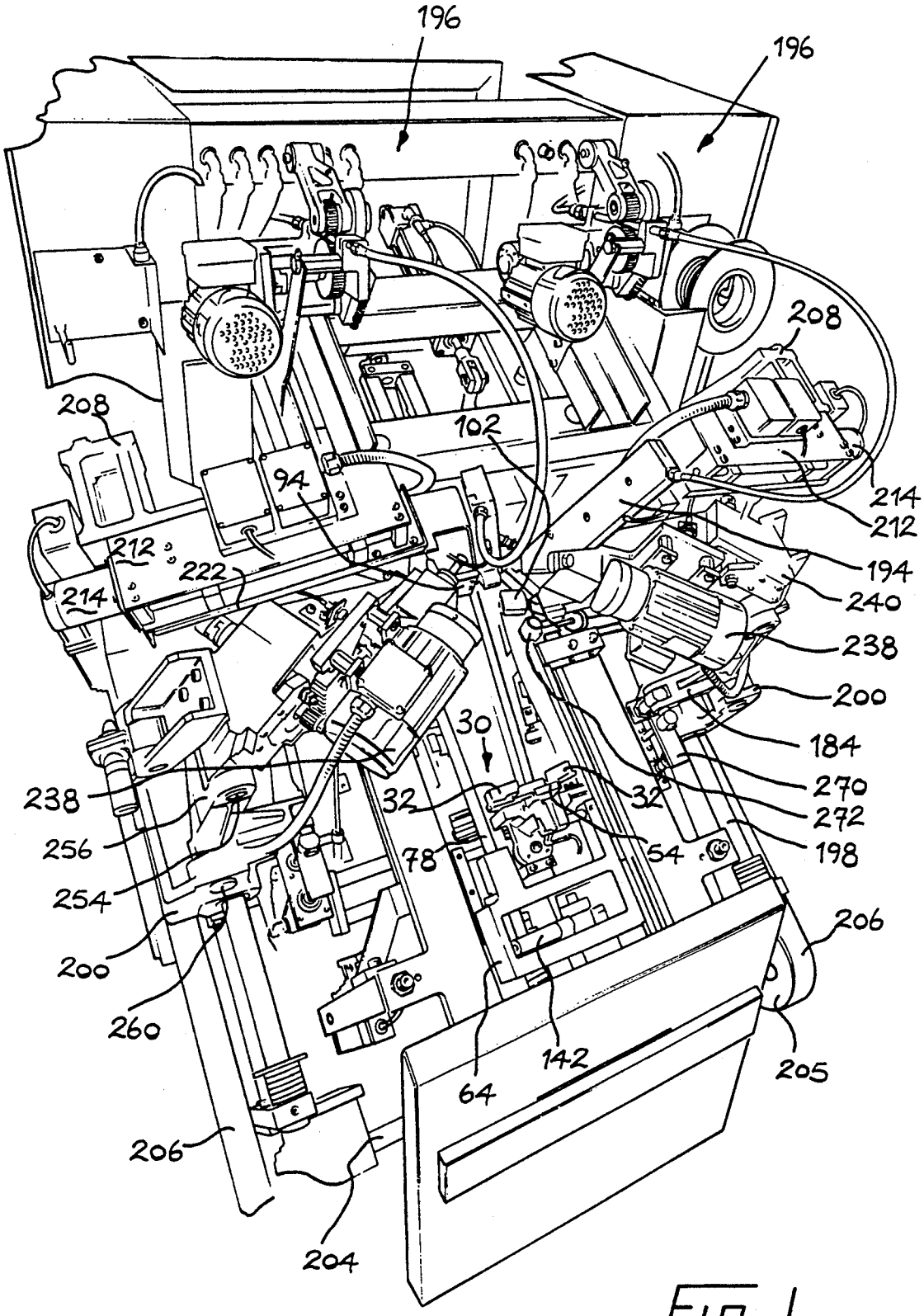
FIG. 1 is a front perspective view of the machine in accordance with the invention.

The machine in accordance with the invention also comprises adhesive-applying means generally designated 190 (FIG. 8). said means 190 comprises two nozzles 192 with each of which is associated a melt chamber 194 and a feed mechanism generally designated 196 (see FIG. 1) by which adhesive in rod form can be fed to the melt chambers 194. The feed mechanism 196 in each case is generally as described in EP-A 0 335 566 and will not be further described here.

The nozzles 192 follow independent paths along marginal portions of opposite sides of the insole, each path being under any suitable control, preferably however under programmed control. The two nozzles are similarly mounted (but on a mirror-opposite basis) and only one will now be described.

Extending along the outside of the main machine frame are two parallel slide rods 198 (FIGS. 8 and 9) on which a carriage 200 is movable. To this end a stepping motor 202 is effective through a gearbox 203 to drive a drive shaft 204 having drive pulleys 205 at opposite ends thereof. Around each pulley a timing belt 206 is entrained, which is connected to the carriage 200. Idler pulleys 207 are arranged at the opposite ends of the slide rods 198

Mounted on a bracket 208 (FIG. 9) upstanding from the carriage 200, for movement about a pivot 209, is a lever 210 on which in turn a carrier block 212 is supported. The carrier block 212 supports a stepping motor 214 which drives a ball screw 216 captively supported on blocks 218 secured to the carrier block 212. Operatively connected to the ball screw 216 is a drive block 220 on which a plate 222 is carried for sliding movement along slide rods 224 supported by the carrier block 212. The melt chamber 194 is supported by a bracket 223 on an end portion of the plate 222 and thus is movable in a direction extending transversely of the shoe bottom under the action of the stepping motor 214. In this way, and by reason of the lengthwise movement of the carriage 200 for the nozzle under the action of the stepping motor 200, the nozzle 192 can be caused to track in X and Y directions along the shoe bottom.

In order to accommodate heightwise variation in the shoe bottom contour, the lever 210 is urged about the pivot 209, so as to maintain contact between the nozzle and the shoe bottom, under the action of a piston-and-cylinder arrangement 226 mounted on the carriage 200.

Figure 8:
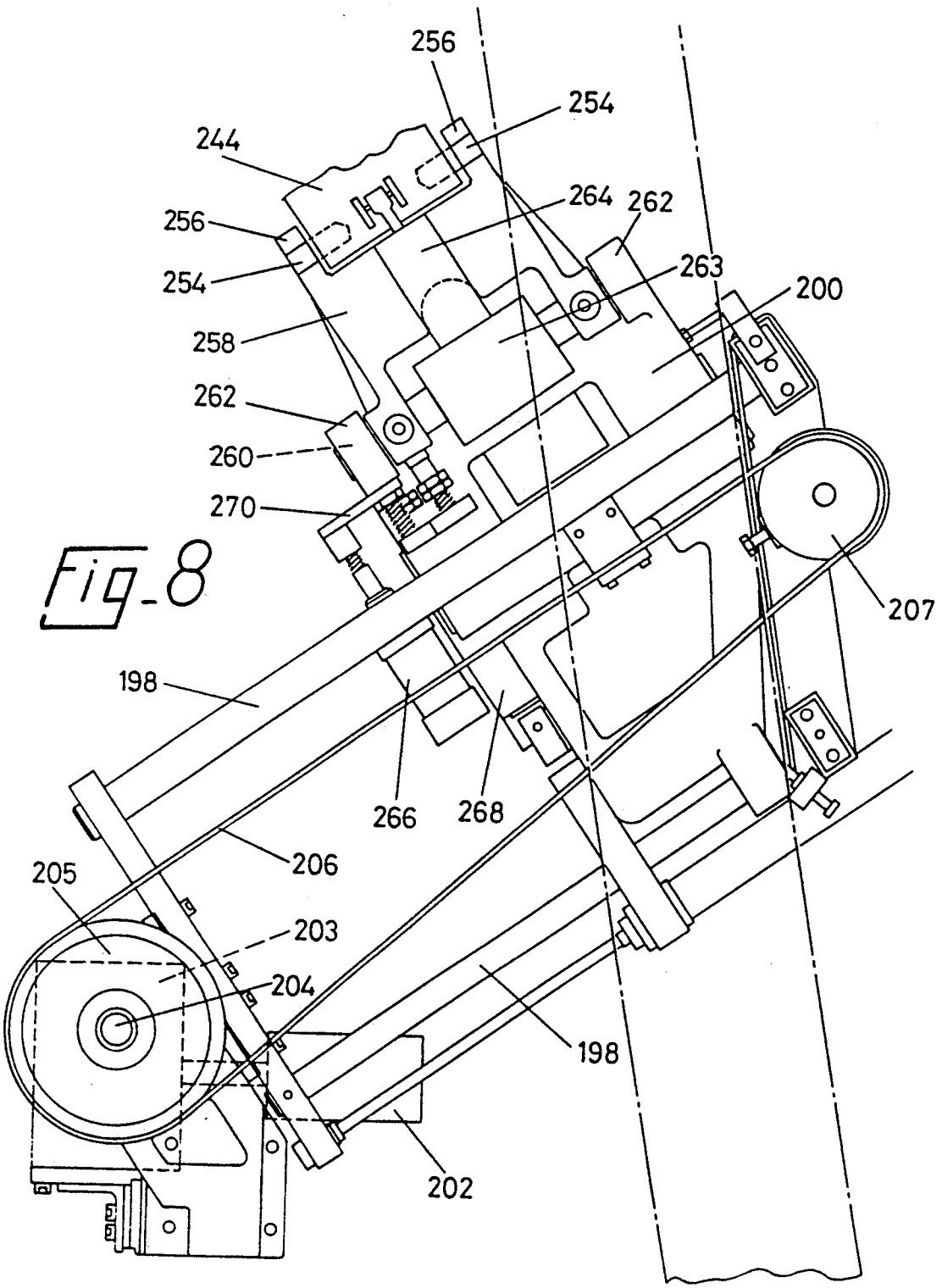
FIG. 8 is a fragmentary side view illustrating a carriage for adhesive-applying means and a side lasting assembly of the machine in accordance with the invention.
Figure 9:
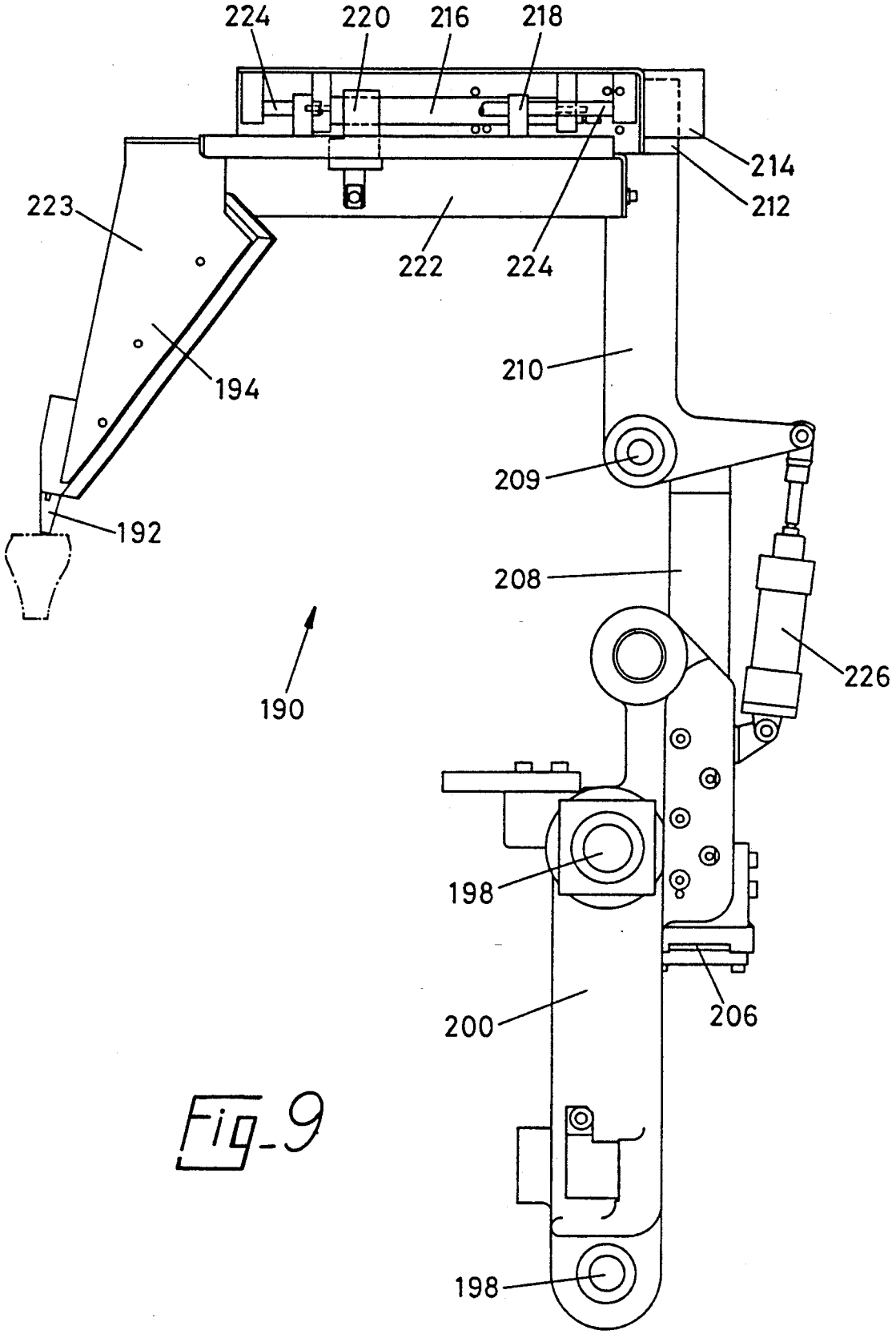
FIG. 9 shows details of the adhesive-applying means of the machine.

The machine in accordance with the invention still further comprises two side lasting assemblies generally designated 230; these two assemblies are also mirror-opposites and only one will therefore now be described with reference to FIGS. 8 and 10. Each side lasting assembly 230 comprises a lasting roller 232 (or 232'), details of which will be set out hereinafter. Each side lasting roller is mounted in a bearing 234 and is driven through a system of belts and pulleys generally designated 236 by a motor 238. The parts of the assembly 230 just described are all mounted on a support plate 240, itself mounted for pivotal movement, about an axis 242, on a casting 244. For effecting such pivotal movement a gear segment 246, having a centre of curvature at the pivot 242, is mounted on the plate 240 and meshes with a drive pulley 248 which is driven, through a further system of timing belts and gears generally designated 250, from an output shaft of a stepping motor 252 mounted on the casting 244. It will thus be appreciated that the stepping motor 252 controls the angle of tilt of the lasting roller about the axis 242, whereby the roller can accommodate to the widthwise contour of the shoe bottom being operated upon.

The casting 244 is itself mounted for pivotal movement on stub shafts 254 extending inwardly of lugs 256 formed on a carrier block 258 which is itself carried on a further shaft 260 supported at opposite ends by lugs 262 formed on the carriage 200. Also mounted on the shaft 260, between the lugs 262, is a mounting 263 for a piston-and-cylinder arrangement 264 by which the casting 244 is urged in such a direction that the lasting roller is held against the shoe bottom as it is caused to operate progressively therealong.

The machine further comprises means for effecting pivotal movement of the carrier block 258 about the shaft 260, said means comprising two piston-and-cylinder arrangements 266, 268 which are mounted on the carriage 200 and are caused to act upon a plate 270 secured to an inwardly directed arm 272 integral with the carrier block 258. The piston-and-cylinder arrangement 266 is generally actuated so that its piston rod is fully extended and in this case the lasting roller is held with its tip at or adjacent the longitudinal centre line of the shoe support 20, as shown in full line in FIG. 10. In this condition the piston rod of the piston-and-cylinder arrangement 268 is at an intermediate position such that it can be either further extended or fully retracted when the piston-and-cylinder arrangement 266 is de-actuated. In this way, the piston-and-cylinder arrangement 268 is effective to cause pivotal movement of the carrier block 258 which results in the lasting roller being either urged over, i.e. beyond, the longitudinal centre line of the shoe support 20 (in the case of extension of the piston rod of the arrangement 268), as shown in chain-dot line in FIG. 10, or being withdrawn from adjacent said longitudinal centre line (in the case of retraction of said piston rod). It will of course be appreciated that the two lasting rollers must be actuated together so that as one is moved beyond the longitudinal centre line the other is withdrawn and vice versa, in order to avoid collision. The purpose of this so-called "shogging" movement is to enable the lasting rolls to track along opposite marginal portions of the shoe bottom which are not symmetrical along the longitudinal centre line of the shoe support, and indeed one of which may, especially toward the end, cross such longitudinal centre line.

Figure 11:
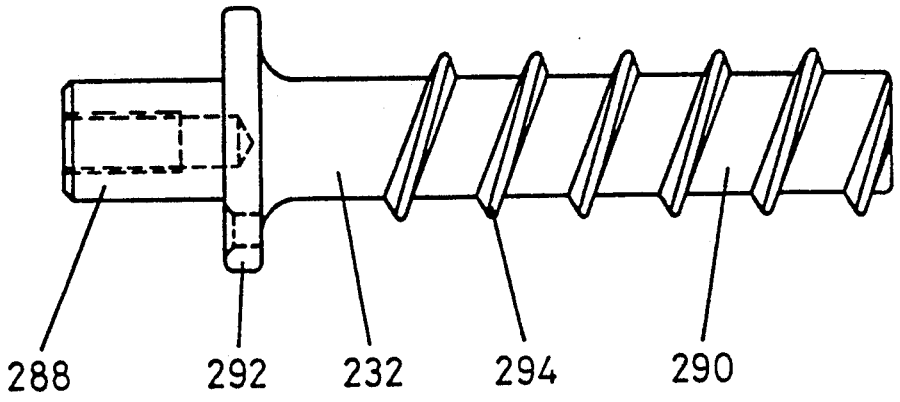
FIG. 11 and 12 show details respectively of a lasting roller and an alternative lasting roller for use in the side lasting assembly, each being illustrative of the invention in its lasting roller aspects.

As is conventional, the lasting rollers 232 to be used in the machine described above are generally similar to one another, except that the threads thereof are of opposite hand. Only one lasting roller 232 in accordance with the invention will therefore now be described with reference to FIG. 11. The lasting roller 232 is an integral unit comprising a supporting stub shaft portion 288 which is internally threaded and by which the lasting roller can be operatively connected to the output of the motor 238. Formed integral with the stub shaft 288 is a lasting element 290, spaced from the stub shaft by a flange portion 292. The lasting element 290 comprises a so-called "single-start" helical rib arrangement 294 formed integral therewith, the pitch of such helical rib arrangement being in the order of 10 to 15 mms, preferably 12 to 13 mms; in the particular lasting roller 232 shown in FIG. 11 the pitch of the helical rib arrangement is 12.7 mm. The outside diameter of the lasting element 290 (i.e. inclusive of the helical rib arrangement 294), furthermore, is 15 to 25 mms; in the particular roller 232 shown in FIG. 11, the outside diameter is 22 mms. In another lasting roller in accordance with the invention and otherwise similar to the roller 232, the outside diameter is 18 mms. The depth of the rib arrangement is in the range 1.5 to 2.5 mms, preferably 2 mms.

Figure 12:
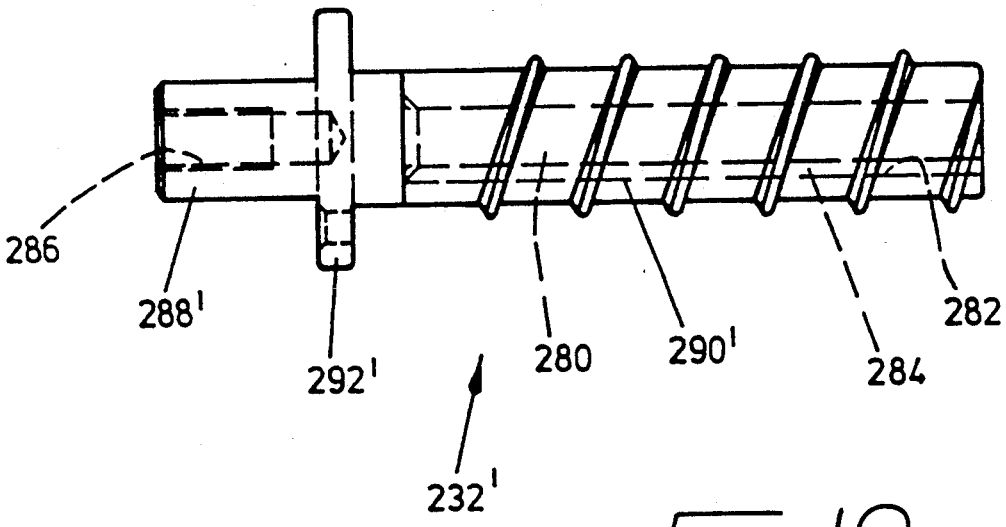

An alternative lasting roller 232' will now be described with reference to FIG. 12. This roller comprises a steel support shaft 280 having at one end a stub shaft portion 288' which is internally threaded whereby the roller can be mounted in a conventional manner in a side lasting machine and be operatively connected with the output of the motor 238. The shaft has formed integral therewith a flange 292' providing one end stop for a sleeve 290' which can be received on and carried by the shaft 280. For effecting rotation of the sleeve 290' together with the shaft 280, furthermore, a keyway 282 is provided in the sleeve, in which keyway a rib 284 formed on the outside of the shaft 280 is accommodate. Alternatively, the sleeve may be bonded to the shaft, using an adhesive to retain the sleeve, e.g. upon reactivation by heat. The sleeve 290' constitutes a lasting element of the lasting roller 232' and together roller 232'.

As in the case of the lasting element 290 of the lasting roller 232, the lasting element constituted by the sleeve 290' has a "single start" helical rib arrangement 294 formed integral therewith, the dimensions of said arrangement being as set out above in the case of the lasting roller 232.

In the case of both lasting rollers 232, 232' described above the lasting element 290 (290'), including the integral helical rib arrangement 294 thereof, is made of a non-metallic material, more particularly a synthetic plastics or ceramic material, having a coefficient of friction which is preferably of the same order as that of a chrome-plated surface and in any event lies in the range 0.04 to 0.15, when measured against a standard steel surface. Similarly, the preferred material of the lasting element 290 has an abrasion resistance which is equivalent to or indeed better than that of a chromium-plated surface.

The following materials have been provided to be satisfactory in this regard: ERTALYTE thermoplastic polyester, which is understood to be an unreinforced partly crystalline thermoplastic polyester based on polyethylene terephthalate (PETP). It is said to have high hardness, stiffness, wear resistance and excellent sliding properties. (ERTALYTE is a Registered Trade Mark); ERTA PEEK, which is a thermoplastic resin material with properties matching those of the previous material. (ERTA is a Registered Trade Mark); MACOR machinable glass ceramic material, which is said to be a high performance material machinable with conventional metal-working tools. It is lightweight but strong, is non-wetting and abrasion-resistant and has a high lubricity. (MACOR is a trade mark of McGeoch Ltd.); SINTOX ceramic materials, which are sintered materials. The particular material selected is the FA grade, which has a 95% alumina content and exhibits good wear and impact resistance, is hard and stiff. (This material is available from Lodge Ceramics Ltd, of Rugby, England.)

It is to be noted that where the ceramic materials referred to are used, preferably they are in the forms of the lasting roller 232', the shaft 280 providing additional reinforcement for the ceramic material.

In each case the helical rib arrangement 294 is machined on the surface of the lasting element; alternatively, however, the element and integral rib arrangement may be moulded.

Also envisaged within the scope of the present invention is a roller the body and helical rib arrangement of which are made of metal and which are then coated with a synthetic polymer material. In this latter case the following coating compounds have proved to be satisfactory: XYLAN 8840 fluorocarbon coating, which is a tough durable coating with good non-stick properties. (XYLAN is a trade mark of Whitford Plastics Ltd, of Runcorn, England); Titanium nitride. In each case a double coating is the preferred use.

Figure 10:
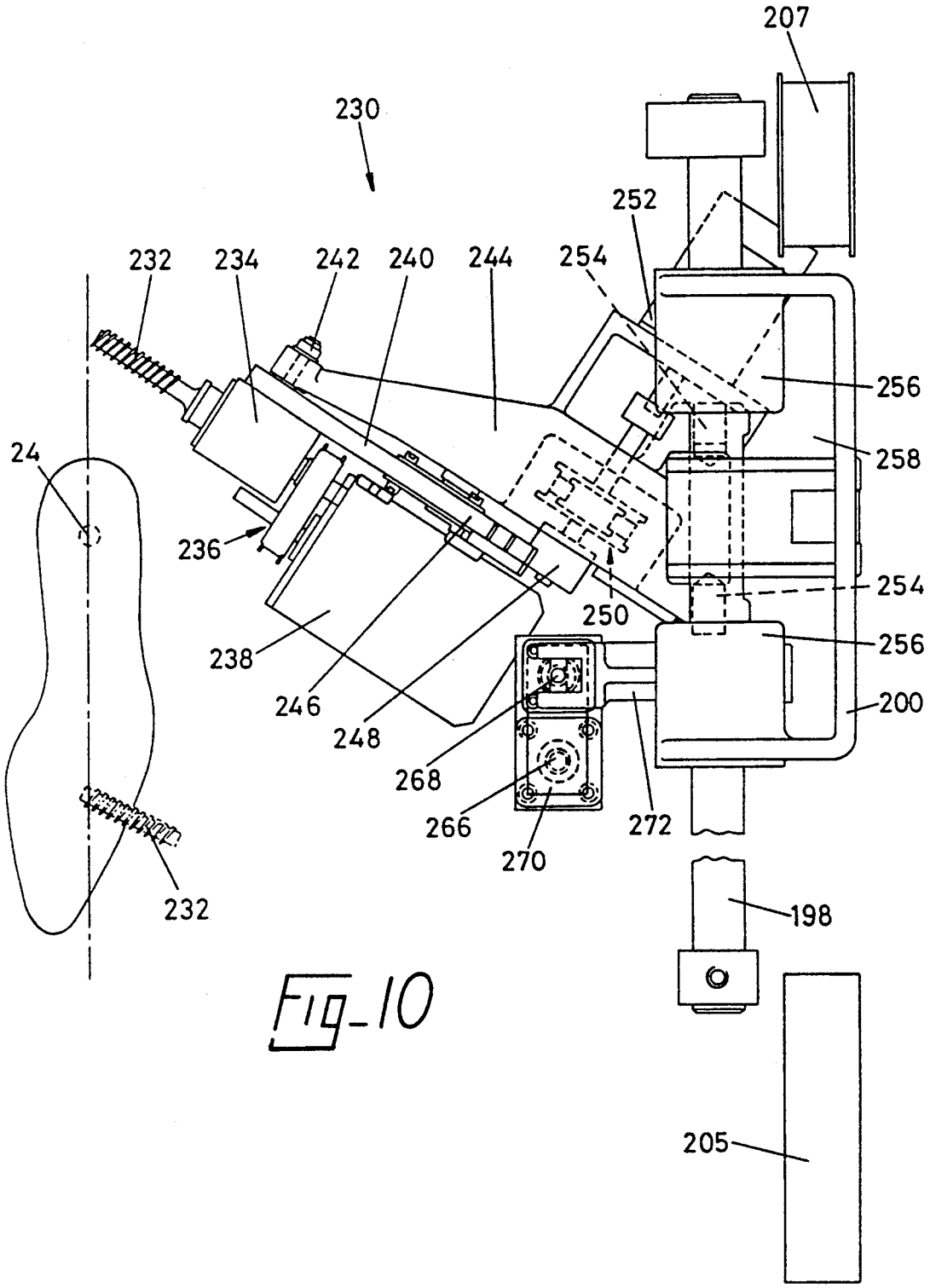
FIG. 10 shows details of a side lasting assembly of the machine.

It will also be noted from FIG. 10, that the axis of rotation of each lasting roller 232 lies at an angle to the longitudinal centre line of the shoe support, and thus of the operating locality of the machine. More particularly, the acute angle which is thus formed is in the order of 50° to 62° and in a preferred version (as shown in the drawing) is 57°. Moreover, in the operation of the machine the rollers 232 are rotated such that the portion engaging the shoe upper at any given time moves in the same direction as that in which the lasting roller 232 moves relative to the shoe bottom. Thus (viewing from the front of the machine) the left-hand roller 232 is provided with a right-hand thread and the right-hand roller with a left-hand thread.

It has been found that, in the operation of the machine, particularly good lasting results have been achieved, and in particular that the formation of so-called "loops", which are liable to be formed especially at the ball region of the "outside" of the shoe bottom, are avoided. This is considered to be achieved by the combination of the particular size of the roller and its helical rib arrangement 294, its angular disposition to the longitudinal centre line of the operating locality, and also its direction of rotation.

It will be recalled that the casting 188 of the jackpost 22 is mounted for limited pivotal movement about the axis 120. The axis 120 is in the form of a pivot pin which is itself mounted on a lever 300 (FIG. 5) which can rock about a pivot 302 secured to a stationary frame portion of the machine. The opposite end of the lever 300 provides an abutment surface against which a piston rod 304 of a diaphragm-type piston-and-cylinder arrangement 306 can act, the arrangement 306 also being mounted on a stationary frame portion of the machine. In this way, as will be referred to hereinafter, bedding pressure may be applied to the heel seat of a shoe supported on the last pin 24.

In using the machine described above, with a shoe supported by the shoe support 20 the machine cycle is initiated whereby firstly the side clamp members 184 are moved inwardly against the shoe upon actuation of piston-and-cylinder arrangements 186. At the same time, the nozzles 192 of the adhesive applying means 190 move downwardly into engagement with the insole of the shoe toewardly of the backseam region thereof by the action of piston-and-cylinder arrangements 226, and thereafter they are moved heelwardly by the action of the stepping motor 202, acting on the carriages 200. At this stage the nozzles are closely adjacent one another so that they move to a position in the region of the backseam and adjacent the insole edge. If the lasting margin has previously been in-flanged, then the nozzles move beneath such in-flanged portion. In this position the feed mechanisms 196 for the adhesive are initiated so that adhesive is then applied from the nozzles to the insole and, under the influence of stepping motors 214 and stepping motor 202, the nozzles are caused to move along a predetermined path which is preferably parallel to the insole edge thus to apply adhesive from the backseam region of the shoe bottom toewardly up to the previously lasted toe portion of the shoe.

The path may be controlled by any conventional means. For example, and indeed preferably, the path of the nozzles has previously been digitised, in terms of coordinate axis values which are directly then applicable to the stepping motors referred to; conveniently the paths are reversible for left and right shoes and in addition, according to the length of shoe as measured by the linear potentiometer 84, the paths are graded.

At this stage the rollers 232, which are still held out of engagement with the shoe bottom, are caused to begin rotation under the action of motors 238 and, when the nozzles have moved sufficiently forwards of the heel breast line region of the shoe bottom by a distance more or less equal to the spacing between the nozzles and the rollers (approximately 75 mm in the machine described above), the rollers are moved downwardly under the action of piston-and-cylinder arrangements 264 and engage the lasting marginal portions of the shoe upper. By reason of the rotation of the lasting rollers 232 as described above, furthermore, the helical rib arrangement 294 of each effects an inwiping movement on such lasted marginal portion at the point of engagement and also presses said lasting marginal portion against a corresponding marginal portion of the insole, thus causing the two marginal portions to be bonded together by the previously applied adhesive.

Although at each side of the machine the nozzle and side lasting roller are mounted on a common carriage, namely the carriage 200, nevertheless they are capable of dependent widthwise movement and indeed heightwise movement, so that both can track along the shoe bottom and indeed their operating path can be terminated independently. When a programmed control is provided, the boundary of the previously toe-lasted portions of the shoe bottom can be "taught" and thus it can be ensured that both the nozzles and thereafter the rollers are lifted off when such boundary region has been traversed. Moreover, the cement feed mechanisms 196 are switched off some 20 to 30 mm from the taught position, so that there is no excess of adhesive at the termination of the nozzle path, and in addition, the feed mechanisms 196 are so arranged that following such switching off they can reverse the feed of the adhesive rod, thereby effectively causing adhesive to be sucked back from the end of the nozzle, thereby avoiding drooling or other detrimental deposition of cement when not required.

Once the rollers 232 have engaged the shoe bottom, the shoe heel end positioning mechanism 86 can be moved to its out-of-the-way position without the shoe becoming destabilised; the shoe is of course at this stage held by the side clamping members 184 and by the toe support 30, as well as benefiting from the stabilising effect of the downward pressure applied by the rollers themselves. Once the shoe heel end positioning mechanism 84 is removed, the heel band mechanism 150 is moved about its axis 166 to a position closely adjacent the heel end of the shoe, but stopping short of engagement therewith. In this condition, the wiper head 172 of the wiper mechanism 170 is advanced, the block 178 engaging with its wings **178*a* the back of the heel band 152 and urging it in that region against the shoe. In this way the wiper head 172 is positioned correctly in accordance with the heel end of the shoe; moreover, the last part of the heel band movement is thus parallel with the shoe bottom, thereby avoiding any tendency (which could have arisen with a purely arcuate movement of the heel band) to dislodge the heel end of the shoe on its last. The wings of the heel band 152 are then urged into embracing engagement with the heel end of the shoe under the action of piston-and-cylinder arrangement 162, whereupon the side clamping members 184** can be retracted.

With the shoe thus clamped the bar lock arrangement 126, by which the post 116 of the jackpost 22 is held in its heightwise position, is released and an upward yielding pressure is applied by the piston-and-cylinder arrangement 122, the wiper plates 174 then being moved inwardly to wipe the lasting marginal portions in the heel seat region of the shoe over and press them against corresponding marginal portions of the insole, while said upward yielding pressure remains applied. (It will of course be appreciated that at this stage the bar lock arrangement 138, by which the toe support 30 is held is in its operative position remains applied).

With the wiper plates 174 in their inwiped position, the bar lock 126 is re-applied thus to lock the post 116 in relation to the casting 118, and bedding pressure is then applied through the composite unit of post and casting 116, 118 from the diaphragm piston-and-cylinder arrangement 206 acting through the lever 200 this bedding pressure thus urges the shoe upwardly against the under-side of the wiper plates 174. Bedding pressure remains applied according to the time required for ensuring a consolidated bond between the in-wiped lasting marginal portions and the corresponding marginal portions of the insole.

At the end of this dwell time the bedding pressure is releived and the wiper head 172 is retracted, the wiper plates 174 retracting within the wiper head 172, the heel band 152 is released, and at the same time the abutment plate 54 and the blocks 32 are retracted to release the toe end of the shoe. The heel band mechanism 150 is then caused to pivot about the axis 166 to its out-of-the-way position and the shoe can then be removed from the operating locality of the machine. Thereafter the shoe heel end positioning mechanism 86 can be returned to such operating locality in readiness for the next shoe to be operated upon, and at this time also the post 116 of the jackpost 22 moves back to its loading position.

It should also be noted that after the wiper head 172 has been retracted as described above, the carriage 200 for the nozzles 192 and side lasting assemblies 230 can be retracted and returned to their initial positions in readiness for a next cycle of operation of the machine.

Whereas in the machine just described the position of the heel end of the shoe is determined by the shoe heel end positioning mechanism 86, in other machines in accordance with the invention the heel band mechanism 150 may instead be used for this function, in which case the plate 94 would be dispensed with and the heel seat height gauge device 110 would be mounted in an alternative manner, e.g. on the casting 154 of the heel band mechanism.

We claim:

1. A machine for lasting side portions of shoe uppers comprising a shoe support for supporting, bottom up, a shoe on a last with an insole on the last bottom, and two side lasting assemblies, arranged one at each side of the shoe support, for operating progressively along opposite side portions of a shoe supported by the shoe support in a direction from the heel end to the toe end, each side lasting assembly comprising a lasting roller having a helical rib arrangement which, as the roller is caused to rotate in engagement with a lasting marginal portion of the upper of such shoe, effects an inwiping action on said portion and presses it against a corresponding marginal portion of the insole of such shoe and an axis of rotation of each roller being inclined to a longitudinal centre line of the shoe support at a fixed angle, with a free end of the roller directed towards the heel end of the shoe, wherein said fixed angle lies in the range 50° to 62°.

2. A machine according to claim 1 wherein said fixed angle is in the order of 57°.

3. A machine according to claim 1 wherein the direction of rotation of each roller is such that the surface portion thereof in pressing engagement with the shoe is moving toewardly.

4. A machine according to claim 1 wherein the outside diameter of each roller is in the order of 18 mm.

5. A machine according to claim 1 wherein the outside diameter of each roller is in the order of 22 mm.

6. A machine according to claim 1 wherein the helical rib arrangement comprises a single rib having a constant pitch dimension, and wherein said constant pitch dimension lies in the range of 10 to 15 mm.

7. A machine according to claim 6 wherein the constant pitch dimension lies in the range 12 to 13 mm.

8. A machine according to claim 6 wherein the rib has a constant height dimension and wherein said constant height dimension lies in the range 1.5 to 2.5 mm.

9. A machine according to claim 1 wherein each lasting roller is supported for tilting movement about an axis extending perpendicularly to the axis of rotation of the roller thus to vary the angle at which the roller is pressed into engagement with the shoe as aforesaid during the operation of the machine.

10. A machine according to claim 9 wherein an n.c. motor is provided for effecting such tilting movement of the lasting roller under programmed control.

11. A lasting roller comprising a cylindrical body which has a helical rib arrangement on the outer surface thereof whereby as the roller rotates while in contact with a lasting marginal portion of a shoe upper the helical rib arrangement can effect an inwiping movement on such lasting marginal portion, the helical rib arrangement comprising a single rib having a fixed pitch dimension, wherein the fixed pitch dimension lies in the range 10 to 15 mm and the outside diameter of the roller lies in the range 15 to 25 mms.

12. A lasting roller according to claim 11 wherein the pitch of the rib in the order of 12 to 13 mms.

13. A lasting roller according to claim 19 the outside diameter of which is in the order of 18 mm.

14. A lasting roller according to claim 11 the outside diameter of which is in the order of 22 mm.

15. A lasting roller according to claim 11 where the height of the rib is in the order of 1.5 to 2.5 mms.

* * * * *